US005551779A

United States Patent [19]

Gantner et al.

[11] Patent Number: 5,551,779

[45] Date of Patent: Sep. 3, 1996

[54] MIXING APPARATUS FOR COUNTERBALANCING FLOWABLE MASSES

[75] Inventors: Gebhard Gantner, Nenzing; Fritz Mark, Mäder, both of Austria

[73] Assignee: Hilti Aktiengesellschaft, Schaan, Liechtenstein

[21] Appl. No.: 516,116

[22] Filed: Aug. 17, 1995

Related U.S. Application Data

[63] Continuation of Ser. No. 156,041, Nov. 23, 1993, abandoned.

[30] Foreign Application Priority Data

Nov. 23, 1992 [DE] Germany ..... 42 39 284.5

[51] Int. Cl.[6] ..... B01F 9/02

[52] U.S. Cl. ..... 366/217; 494/33

[58] Field of Search ..... 366/54, 55, 62, 366/63, 91–93, 197, 198, 200, 204, 208, 209, 213, 214, 217, 220, 232, 235, 605; 94/19, 33

[56] References Cited

U.S. PATENT DOCUMENTS

| | | | |
|---|---|---|---|
| 1,011,929 | 12/1911 | Ecaubert | 366/213 X |
| 3,199,775 | 8/1965 | Drucker | 366/217 X |
| 3,235,173 | 2/1966 | Unger | 494/19 X |
| 3,836,010 | 9/1974 | Lampson | 212/49 |
| 4,235,553 | 11/1980 | Gall | 366/208 |
| 4,357,732 | 11/1982 | Hickman | 16/81 |
| 4,497,581 | 2/1985 | Miller | 366/605 X |
| 4,728,197 | 3/1988 | Reinhard | 366/219 |
| 5,167,448 | 12/1992 | Herold et al. | 366/217 X |
| 5,352,037 | 10/1994 | Jouvin | 366/219 |

FOREIGN PATENT DOCUMENTS

| | | | |
|---|---|---|---|
| 3193127 | 8/1991 | Japan | 366/217 |
| 1472109 | 4/1989 | U.S.S.R. | 366/220 |
| 1387402 | 3/1975 | United Kingdom | 366/220 |
| 9206777 | 4/1992 | WIPO | 366/217 |

*Primary Examiner*—Charles E. Cooley
*Attorney, Agent, or Firm*—Anderson Kill Olick & Oshinsky, P.C.

[57] ABSTRACT

An apparatus for mixing at least one flowable mass includes a rotatable support (2), a container carrier (1) and container (4) and a separate housing (3). The container carrier (1) and housing (3) each has a central axis inclined relative to the axis of the rotatable support (2). The container carrier (1) can be driven around its axis opposite to the rotational direction of the rotatable support (2). The apparatus is balanced by an equalizing mass (3*a*) in the housing (3) disposed diametrically opposite the container carrier (1).

9 Claims, 3 Drawing Sheets

23
24
25a
25
21a
25
25a
24
20
21

MIXING APPARATUS FOR COUNTERBALANCING FLOWABLE MASSES

This is a continuation application of Ser. No. 08/156,041, filed Nov. 23, 1993 now abandoned.

BACKGROUND OF THE INVENTION

The present invention is directed to an apparatus for mixing at least one flowable mass located in a container and positioned in a container carrier mounted on a rotatable support. The container carrier has an axis of rotation inclined inwardly relative to the central axis of the rotatable support. A drive rotates the rotatable support and also rotates the container carrier around its axis of rotation in a direction counter to the rotation of the rotatable support.

In many industries, crafts and trades there is the problem of supplying a plurality of mixtures rapidly at any time for performing different types of work. It is economically and technically impossible in such industries, crafts and trades to store a plurality of the required mixtures involving special colors and specific compositions, as well as for providing stability during storage. Accordingly, standard masses are usually purchased and modified as required. Such modification is effected by adding colored pastes, fillers, softeners, cross-linking agents, catalyzers and the like.

The prepared masses can be a single component or multi-component, liquid and pasty masses, used at the present time as bonding agents or as, encapsulating, casting, coating or masses. Such masses, as a rule, react after being applied and result in solid, gel-like or rubber-like products. Multi-component masses must be thoroughly mixed prior to application.

Apparatus for preparing such mixtures or masses have been known, particularly in dentistry, and comprise a rotatable support or arm rotating about an axis with a container carrier located in an outer peripheral region of the support and inclined towards the center of the support. The container carrier is driven around its axis of rotation, counter to the rotational direction of the rotatable support.

High centrifugal forces are generated by the high revolutions per minute of the rotatable support with the container located in the radially outer peripheral region of the support causing the mass being mixed to press against the outwardly oriented internal wall of the container. As the container rotates in the opposite direction, the somewhat stationary mass is peeled off. Due to the inclined position of the container, the mass slides off the free surface in a spiral shape and is deposited on or stripped from the mass. Since the container has a relatively large free surface on the side oriented towards the central axis of the support, new material is continuously peeled off the mass.

To perform the mixing process described above, the container cannot be completely filled. Depending upon the diameter and height as well as the inclination of the container, the maximum usable filling volume can vary to a great extent.

Known mixing apparatuses are suitable only for smaller quantities up to about 70 g. A counterbalancing element is located on the rotatable support directly diametrically opposite the container carrier, because of the developing centrifugal forces. The mass of the counterbalancing element is matched to the weight of the container carrier as well as to an average weight of the container and the mass to be mixed.

These known mixing apparatuses have the disadvantage of a limited mixing capacity and the counterbalancing element is never precisely matched to the container carrier along with the container and mass. As a result, there is an unbalanced behavior of the rotatable support, especially during the initial acceleration phase.

SUMMARY OF THE INVENTION

Therefore, the primary object of the present invention is to provide a mixing apparatus, where the counterbalancing element is designed so that a compensation of the mass center of gravity exists at any revolutions per minute of the rotatable support, whereby unbalancing is prevented.

In accordance with the present invention, at least one additional container carrier along with a container or at least an active counterbalancing mass is mounted on the rotatable support, so that the resulting centrifugal forces of the additional container carrier and container or the counterbalancing mass are in equilibrium with the centrifugal forces of the container carrier and container.

Balancing the mixing apparatus is achieved by the disposition of the additional container carrier and container or of the active counterbalancing mass. As a result, no balancing problem develops as the support rotates during operation and during the acceleration phase. The additional container carrier and container or the active counterbalancing mass and housing are located on the same diameter as the container carrier and container. In such a situation, the two container carriers and containers mounted on the rotatable support are designed to be of equal weight and rotated diametrically opposite one another.

To increase the capacity of the mixing apparatus, it is preferable to mount two or more additional container carriers and containers on the rotatable support. Such additional container carriers are arranged with respect to the first container carrier on the rotatable support so that the mixing apparatus is in a balanced state at any revolutions per minute.

If additional container carriers and containers are positioned on the rotatable support rotationally symmetrical to one another and at the same angular spacings, the additional container carriers can be used having the same size and the same mass as the container carrier already positioned on the rotatable support.

Due to the carousel-like arrangement of the container carriers, heavier masses located in the containers of equal weight can be mixed without any unbalancing taking place.

Two or more container carriers positioned in a rotationally unsymmetrical manner relative to one another can be utilized in addition to the container carrier initially disposed on the rotatable support. In such an arrangement, the additional container carriers can be made smaller than the original container carrier located on the rotatable support. To assure an appropriate balancing of the mixing apparatus, the additional container carriers should be disposed offset radially and/or in the circumferential direction relative to the initial container carrier.

The active counterbalancing mass is preferably formed by a flowable medium located in a housing. The housing is secured rigidly and/or non rotationally on the rotatable support. The housing and its contents are subjected only to the rotation of the rotatable support and can be made considerably smaller because of space considerations. The volume of the counterbalancing mass can be smaller than that of the mass to be mixed, if the counterbalancing mass has a higher density than the mass to be mixed. Such an active counterbalancing or equalizing mass maintains the rotatable support in the balanced state during a change in the revolutions per minute thereof during the initial and terminal phases and during constant revolutions per minute operation. In particular during the constant revolutions per minute range of the mixing process, it is assured that the balancing remains optimum in such revolutions per minute state.

Preferably, the flowable counterbalancing mass is bulk material of small grain size. Bulk material of a small grain size has the property of moving in a flowable manner, for gradually displacing the center of gravity of the mass.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there are illustrated and described preferred embodiments of the invention.

DETAILED DESCRIPTION OF THE INVENTION

Figure 1:
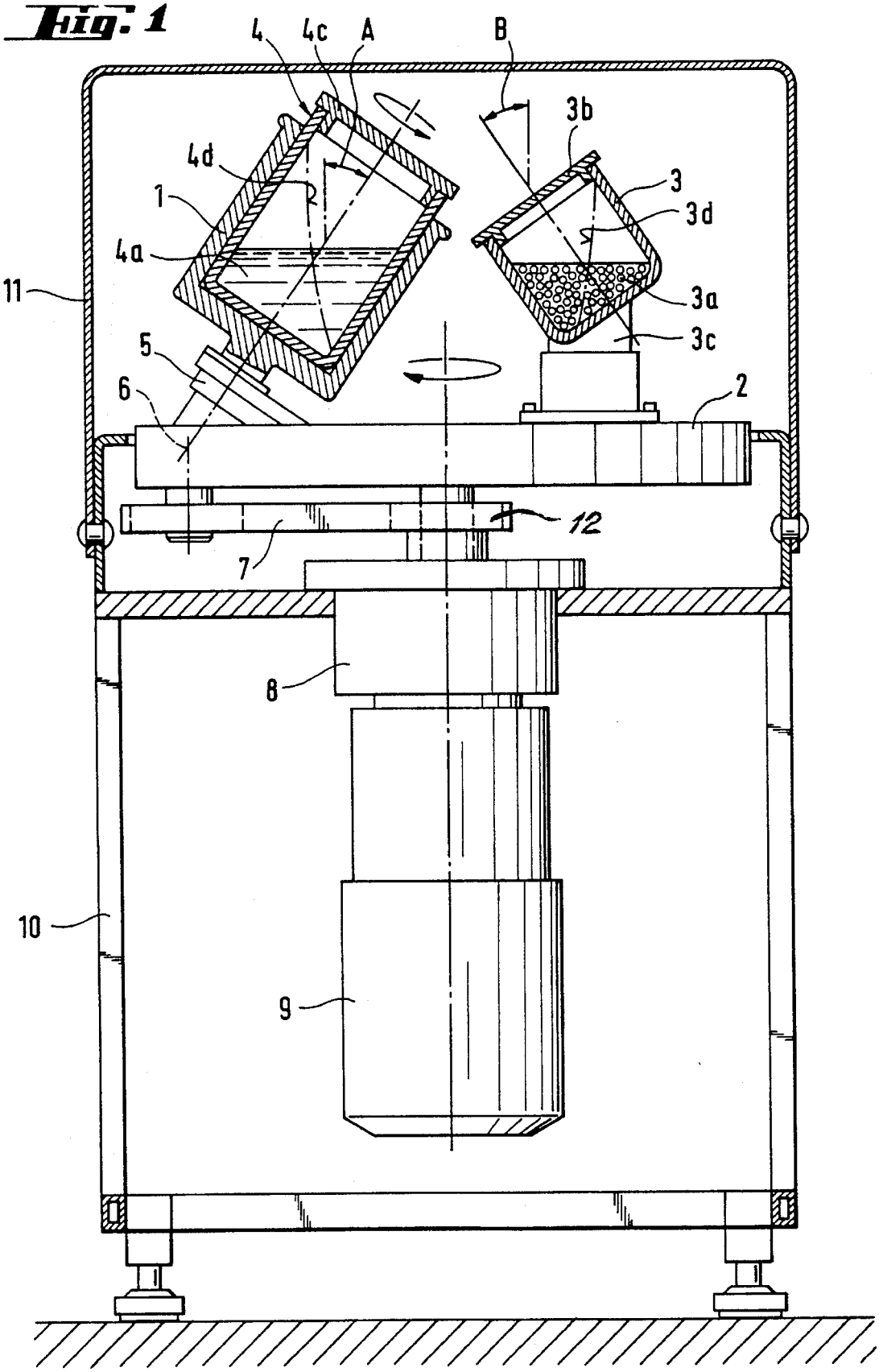
FIG. 1 is a schematic elevational view, partly in section, of a mixing apparatus displaying a container carrier and housing and embodying the present invention.

In FIG. 1 the mixing apparatus includes a rotatable support or table 2 shaped as a rotary arm with a central axis. A container carrier 1 including a container 4 and a housing 3 are mounted on the rotatable support with the housing 3 located diametrically opposite the container carrier 1. The container carrier 1 has an axis of rotation and the housing 3 has a central axis with the axes inclined inwardly toward one another and toward the axis of the rotatable support. The inclination of each of the angle A of the container carrier 1 and of the angle B of the housing 3, relative to the vertical with respect to the horizontally arranged rotatable support 2 amounts to approximately 35°. Angle A is in the range of 15° to 45° depending upon the mixing process and also on the mass to be mixed.

Container carrier 1 with the container 4 is mounted on the rotatable support or table 2, so that the container carrier can rotate around its own axis. An appropriate bearing arrangement 5 for the container carrier 1 is rigidly connected to the rotatable support 2. Container carrier 1 has a drive shaft, not shown. The drive shaft cooperates with an angular drive 6, driven by a toothed belt drive 7 located on the underside of the rotatable support 2. Toothed belt drive 7 is connected with a first take-off or output 12 of a gear box 8 located upwardly from a drive motor 9. The gear box 8 has a second take-off or output with a different revolutions per minute than the first output and serves to drive the rotatable support 2 which must rotate to obtain the mixing process.

Container carrier 1 along with container 4 mounted on the rotatable support 2 performs a rotational movement during the mixing process in an opposite direction to that of the rotatable support 2. The revolutions per minute of the container carrier 1 and of the rotatable support 2 are different. During the mixing operation the rotatable support 2 rotates approximately twice as fast as the container carrier 1.

Housing 3 is rigidly connected to the rotatable support 2 through an intermediate flange 3*c*.

The entire mixing apparatus is supported on a stand 10. The rotatable support 2 and the other parts mounted on it are covered during the mixing operation, for reasons of safety, by a hood 11 which can be displaced upwardly. The mixing apparatus cannot operate as long as the hood is in an open position. A safety switch, not shown, prevents the operation of the apparatus.

The container carrier 1 is matched to the outside diameter of the container 4. If necessary, matched inserts can be used, not shown, so that smaller containers 4 can be inserted into the container carrier 1. The container 4, shown in FIG. 1, has a removable lid 4*c*.

The mass 4*a* located in the container 4 moves during the mixing operation in the direction in which the centrifugal force acts, accordingly, care must be taken to fill the container with an appropriately small amount of mass 4*a* so that the amount of mass 4*a* pressing against the lid 4*c* of the container 4 during the mixing operation is limited.

Housing 3 located diametrically opposite the container carrier 1 is arranged with respect to the height of the container carrier so that the center of gravity of the counterbalancing mass 3*a* within the housing 3 reaches the same level during the mixing operation as the center of gravity of the mass 4*a* to be mixed in the container 4. The counterbalancing mass 3*a* in the housing 3 is a flowable medium and in the present case comprises fine grain lead balls. The mass 4*a* as well as counterbalancing mass 3*a* form parabolic surfaces 4*d*, 3*d* during the mixing operation.

The counterbalancing or equalizing mass 3*a* must be matched by means of its density as a function of the weight or the density of the mass 4*a* to be mixed, so that on one hand the corresponding center of gravity of the mass is achieved by means of the filling volume and on the other hand a balancing of the masses 4*a*, 3*a* occurs by means of the density. When the mixing apparatus is placed in operation, the entire system must be in the balanced state.

Housing 3 has a removable lid 3*b*, so that the counterbalancing mass 3*a* can be adapted to the particular mass 4*a* to be mixed.

Figure 2:
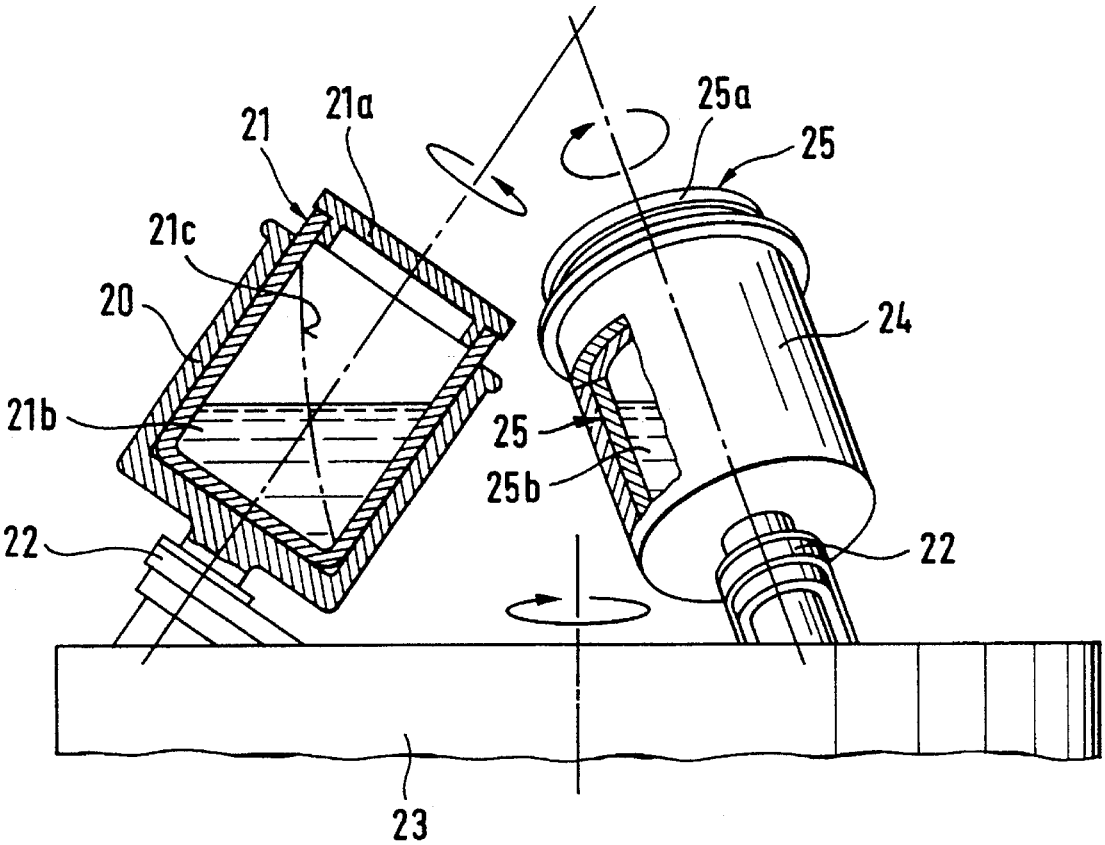
FIG. 2 is a partial schematic elevational view of another embodiment of the present invention utilizing several container carriers.
Figure 3:
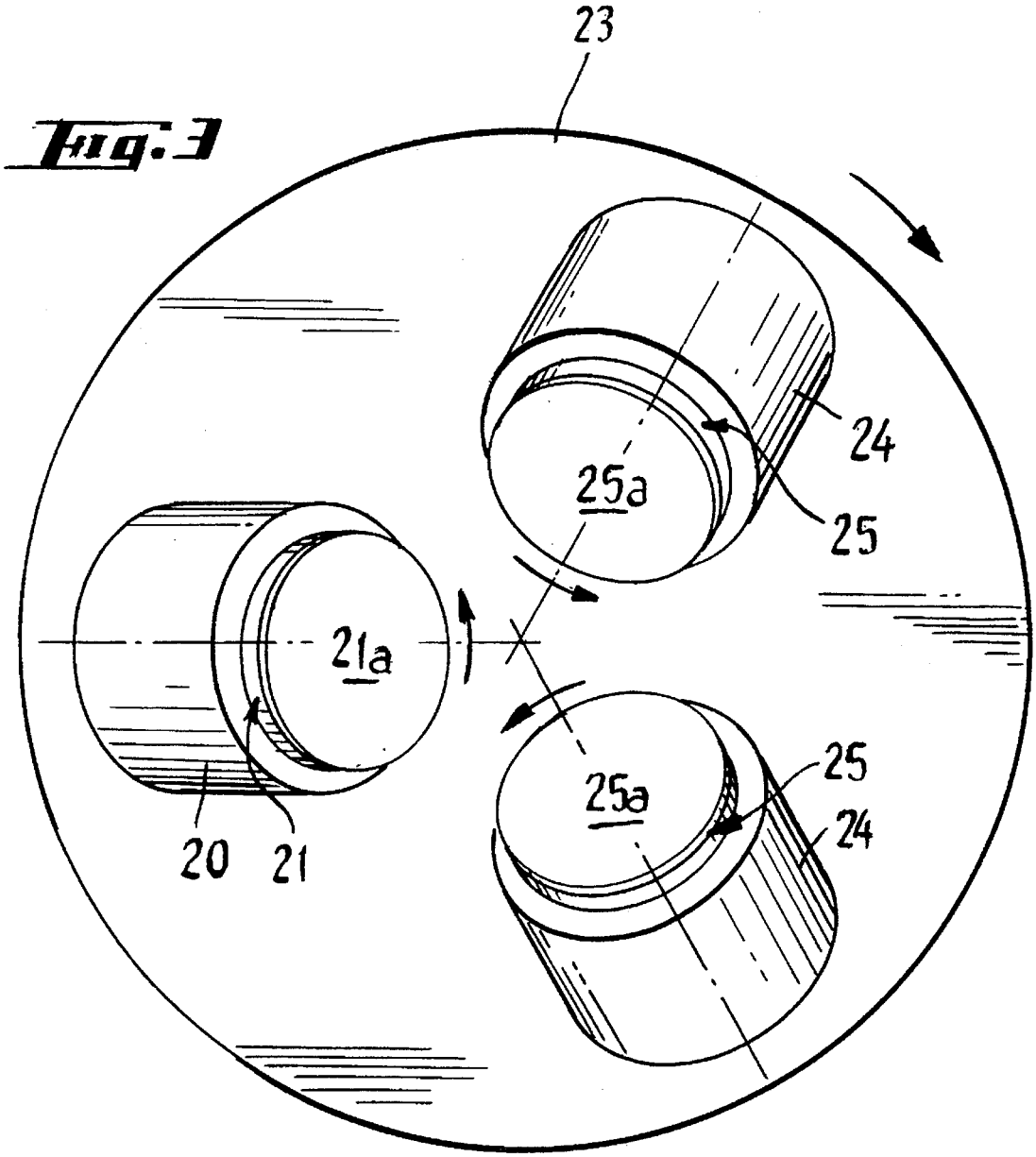
FIG. 3 is a schematic plan view of the embodiment illustrated in FIG. 2.

FIGS. 2 and 3 display an embodiment with a container carrier 20 having a single container 21 with two additional container carriers 24 with containers 25. The container carrier 20 and the additional container carriers 24 have the same spacing from the rotational center of the rotatable support 2 and are located in an outer circumferential region of the rotatable support 23 and are equiangularly spaced apart. In FIG. 2 one of the two additional container carriers 24 with container 25 is not shown, since it is located exactly behind the other container carrier 24, however, all three container carriers 24 are illustrated in FIG. 3. Appropriate bearing arrangements 22 connected to the rotatable support 23 serve to support the container carriers 24 along with the containers 25. The drive of the container carriers 24 and containers 25 is effected in the same manner as in the mixing apparatus shown in FIG. 1.

In FIGS. 2 and 3 containers 21, 25 are each closed by a lid 21*a*, 25*a*. As a result, the filling volume in the containers 21, 25 can be increased. The balancing of the rotatable support 23 is attained by the uniform position of equally large and equally heavy container carriers 20, 24, containers 21, 25 and masses 21*b*, 25*b*. The mass 21*b* forms a parabolic surface 21*c* in the course of the mixing operation and the masses 25*b* form similar parabolic surfaces during the mixing operation.

While specific embodiments of the invention have been shown and described in detail to illustrate the inventive principles, it will be understood that the invention may be embodied otherwise without departing from such principles.

We claim:

1. Apparatus for mixing flowable masses within at least one container comprising a substantially horizontal rotatable support having a substantially vertical central axis of rotation and an upper surface and a lower surface, at least one rotatable container carrier mounted on the upper surface of said rotatable support, said at least one container carrier having an axis of rotation spaced radially outwardly from and inclined inwardly towards the central axis of rotation of said rotatable support, said at least one container carrier being adapted to firmly hold said at least one container containing said flowable masses for rotation therewith, and a drive motor for rotating said rotatable support about the central axis of rotation, said drive motor being arranged coaxially with the central axis of rotation of said rotatable support below said rotatable support and adapted for separately rotating said at least one container carrier together with said at least one container containing said flowable masses about the inclined axis of rotation thereof and counter to the rotational direction of said rotatable support by means of a drive for said at least one rotatable container carrier located below the lower surface of said rotatable support, said rotatable support being rotated about twice as fast as said container carrier, said rotatable support further being provided with a means for dynamically counterbalancing centrifugal forces resulting from rotation of said at least one container carrier together with said at least one container containing said flowable masses therein, such that at all rotational speeds an equilibrium is established between the centrifugal forces acting on said at least one container carrier with said at least one container containing said flowable masses and centrifugal forces acting on said counterbalancing means.

2. An apparatus, as set forth in claim 1, wherein said counterbalancing means comprises a housing located on the upper surface of said rotatable support and having an axis spaced radially outwardly from and inclined inwardly towards the central axis of rotation of said rotatable support, said housing being rigidly connected to said rotatable support and adapted to receive a counterbalancing mass having a center of gravity, which counterbalancing mass being capable of flowing within said housing upon rotation of said rotatable support, such that depending on the rotational speed said center of gravity of said counterbalancing mass achieves the same height above said rotatable support as a center of gravity of said mass contained within said at least one container held by said at least one rotatable container carrier.

3. An apparatus, as set forth in claim 2, wherein said counterbalancing mass is a flowable mass of bulk material.

4. An apparatus, as set forth in claim 2, wherein said housing is inclined with respect to the central axis of rotation of said rotatable support under an angle which corresponds to an angle of inclination between the axis of rotation of said container carrier and the central axis of rotation of said rotatable support, said angle of inclination being in the range of 15° to 45°.

5. An apparatus, as set forth in claim 4, wherein said housing is arranged diametrically opposite said at least one rotatable container carrier.

6. An apparatus, as set forth in claim 5, wherein said drive for said at least one rotatable container carrier comprises a toothed belt drive which is connected with a first take-off of a gear box located upwardly from said drive motor and with an angular drive cooperating with said at least one rotatable container carrier.

7. An apparatus, as set forth in claim 1, wherein said counterbalancing means comprises at least one additional rotatable container carrier mounted on the upper surface of said rotatable support and having an axis of rotation spaced radially outwardly from and inclined inwardly towards the central axis of rotation of said rotatable support, said at least one container carrier and said at least one additional container carrier being arranged on said rotatable support equidistantly from the central axis of rotation thereof, said at least one additional container carrier being adapted to receive and firmly hold at least one additional container containing said flowable masses and being adapted to be driven in a same manner as said at least one rotatable container carrier.

8. An apparatus, as set forth in claim 7, wherein said at least one container carrier and said at least one additional container carrier are arranged on said rotatable support in an outer circumferential region thereof and are equiangularly spaced apart.

9. An apparatus, as set forth in claim 8, wherein two said additional rotatable container carriers are arranged on said rotatable support.

* * * * *